US008705750B2

(12) United States Patent
Berge

(10) Patent No.: US 8,705,750 B2
(45) Date of Patent: Apr. 22, 2014

(54) DEVICE AND METHOD FOR CONVERTING SPATIAL AUDIO SIGNAL

(75) Inventor: Svein Berge, Oslo (NO)

(73) Assignee: Berges Allmenndigitale Rådgivningstjeneste, Oslo (NO)

( * ) Notice: Subject to any disclaimer, the term of this patent is extended or adjusted under 35 U.S.C. 154(b) by 858 days.

(21) Appl. No.: 12/822,015

(22) Filed: Jun. 23, 2010

(65) Prior Publication Data

US 2010/0329466 A1 Dec. 30, 2010

(30) Foreign Application Priority Data

Jun. 25, 2009 (EP) ..... 09163760
Jan. 8, 2010 (NO) ..... 20100031

(51) Int. Cl.
*H04R 5/00* (2006.01)

(52) U.S. Cl.
USPC ..... 381/22; 381/80; 381/103; 381/300; 381/97; 381/98

(58) Field of Classification Search
USPC ..... 381/1, 2, 5, 10, 14, 17, 18, 19, 20, 22, 381/23, 26, 300, 307, 309, 310, 61, 77, 80, 381/89, 332, 91, 94.2, 94.3, 97, 98, 102, 381/103, 119, 120, 92, 122; 700/94
See application file for complete search history.

(56) References Cited

U.S. PATENT DOCUMENTS

| | | | | |
|---|---|---|---|---|
| 6,259,795 | B1 | 7/2001 | McGrath | |
| 6,628,787 | B1 * | 9/2003 | McGrath et al. | 381/18 |
| 6,766,028 | B1 * | 7/2004 | Dickens | 381/310 |
| 2003/0007648 | A1 * | 1/2003 | Currell | 381/61 |
| 2006/0262939 | A1 * | 11/2006 | Buchner et al. | 381/56 |

FOREIGN PATENT DOCUMENTS

| | | |
|---|---|---|
| WO | WO 00/19415 | 4/2000 |

OTHER PUBLICATIONS

Faller, Christof "Parametric Coding of Spatial Audio" Proc. of the 7th Int. Conference on Digital Audio Effects (DAFx'04), Oct. 5-8, 2004, pp. 151-156.
Goodwin, Michael M. et al., "Spatial Audio Scene Coding" Audio Engineering Society Convention Paper 7507, Oct. 2-5, 2008, pp. 1-8.
Pulkki, Ville "Directional audio coding in spatial sound reproduction and stereo upmixing" AES 28th International Conference, Jun. 30-Jul. 2, 2006, pp. 1-8.

* cited by examiner

*Primary Examiner* — Leshui Zhang

(57) ABSTRACT

An audio processor for converting a multi-channel audio input signal, such as a B-format sound field signal, into a set of audio output signals, such as a set of two or more audio output signals arranged for headphone reproduction or for playback over an array of loudspeakers. A filter bank splits each of the input channels into frequency bands. The input signal is decomposed into plane waves to determine one or two dominant sound source directions. The(se) are used to determine a set of virtual loudspeaker positions selected such that the dominant direction(s) coincide(s) with virtual loudspeaker positions. The input signal is decoded into virtual loudspeaker signals corresponding to each of the virtual loudspeaker positions, and the virtual loudspeaker signals are processed with transfer functions suitable to create the illusion of sound emanating from the directions of the virtual loudspeakers. A high spatial fidelity is obtained due to the coincidence of virtual loudspeaker positions and the determined dominant sound source direction(s). Improved performance can be obtained in the case where Head-Related Transfer Functions are used by differentiating the phase of a high frequency part of the HRTFs with respect to frequency, followed by a corresponding integration of this part with respect to frequency after combining the components of HRTFs from different directions.

15 Claims, 3 Drawing Sheets

DEVICE AND METHOD FOR CONVERTING SPATIAL AUDIO SIGNAL

CROSS-REFERENCE TO RELATED APPLICATIONS

This application claims the benefit of priority to European Patent Application No. 09163760.3, filed Jun. 25, 2009, and Norwegian Application No. 20100031, filed Jan. 8, 2010, both of which are hereby expressly incorporated by reference in their entireties.

FIELD OF THE INVENTION

The invention relates to the field of audio signal processing. More specifically, the invention provides a processor and a method for converting a multi-channel audio signal, such as a B-format sound field signal, into another type of multi-channel audio signal suited for playback via headphones or loudspeakers, while preserving spatial information in the original signal.

BACKGROUND OF THE INVENTION

The use of B-format measurements, recordings and playback in the provision of more ideal acoustic reproductions which capture part of the spatial characteristics of an audio reproduction are well known.

In the case of conversion of B-format signals to multiple loudspeakers in a loudspeaker array, there is a well recognized problem due to the spreading of individual virtual sound sources over a large number of playback speaker elements. In the case of binaural playback of B-format signals, the approximations inherent in the B-format sound field can lead to less precise localization of sound sources, and a loss of the out-of-head sensation that is an important part of the binaural playback experience.

U.S. Pat. No. 6,259,795 by Lake DSP Pty Ltd. describes a method for applying HRTFs to a B-format signal which is particularly efficient when the signal is intended to be distributed to several listeners who require different rotations of the auditory scene. However, that invention does not address issues related to the precision of localization or other aspects of sound reproduction quality.

WO 00/19415 by Creative Technology Ltd. addresses the issue of sound reproduction quality and proposes to improve this by using two separate B-format signals, one associated with each ear. That invention does not introduce technology applicable to the case where only one B-format signal is available.

U.S. Pat. No. 6,628,787 by Lake Technology Ltd. describes a specific method for creating a multi-channel or binaural signal from a B-format sound field signal. The sound field signal is split into frequency bands, and in each band a direction factor is determined. Based on the direction factor, speaker drive signals are computed for each band by panning the signals to drive the nearest speakers. In addition, residual signal components are apportioned to the speaker signals by means of known decoding techniques.

The problem with these methods is that the direction estimate is generally incorrect in the case where more than a single sound source emits sound at the same time and within the same frequency band. This leads to imprecise or incorrect localization when there is more than one sound source is present and when echoes interfere with the direct sound from a single source.

SUMMARY OF THE INVENTION

In view of the above, it may be seen as an object of the present invention to provide a processor and a method for converting a multi-channel audio input, such as a B-format sound field input into an audio output suited for playback over headphones or via loudspeakers, while still preserving the substantial spatial information contained in the original multi-channel input.

In a first aspect, the invention provides an audio processor arranged to convert a multi-channel audio input signal, such as a three- or four-channel B-format sound field signal, into a set of audio output signals, such as a set of two audio output signals arranged for headphone or two or more audio output signals arranged for playback over an array of loudspeakers, the audio processor comprising

- a filter bank arranged to separate the input signal into a plurality of frequency bands, such as partially overlapping frequency bands,
- a sound source separation unit arranged, for at least a part of the plurality of frequency bands, to
  - perform a parametric plane wave decomposition computation on the multi-channel audio input signal so as to determine at least one dominant direction corresponding to a direction of a dominant sound source in the audio input signal,
  - perform a decoding of the audio input signal into a number of output channels, wherein said decoding is controlled according to said at least one dominant direction, and
- a summation unit arranged to sum the resulting signals of the respective output channels for the at least part of the plurality of frequency bands to arrive at the set of audio output signals.

Such audio processor provides an advantageous conversion of the multi-channel input signal due to the combination of parametric plane wave decomposition extraction of directions for dominant sound sources for each frequency band and the selection of at least one virtual loudspeaker position coinciding with a direction for at least one dominant sound source.

For example, this provides a virtual loudspeaker signal highly suited for generation of a binaural output signal by applying Head-Related Transfer Functions to the virtual loudspeaker signals. The reason is that it is secured that a dominant sound source is represented in the virtual loudspeaker signal by its direction, whereas prior art systems with a fixed set of virtual loudspeaker positions will in general split such dominant sound source between the nearest fixed virtual loudspeaker positions. When applying Head-Related Transfer Functions, this means that the dominant sound source will be reproduced through two sets of Head-Related Transfer Functions corresponding to the two fixed virtual loudspeaker positions which results in a rather blurred spatial image of the dominant sound source. According to the invention, the dominant sound source will be reproduced through one set of Head-Related Transfer Functions corresponding to its actual direction, thereby resulting in an optimal reproduction of the 3D spatial information contained in the original input signal. The virtual loudspeaker signal is also suited for generation of output signals to real loudspeakers. Any method which can convert from a virtual loudspeaker signal and direction to an array of loudspeaker signals can be used. Among such methods can be mentioned

- Amplitude panning
- Vector-base amplitude panning
- Virtual microphone responses, including higher-order characteristics and spaced layouts Wave field synthesis Higher-order ambisonics Thus, in a preferred embodiment, the audio processor is arranged to generate the set of audio output signals such that it is arranged for playback over headphones or an array of loudspeakers, e.g. by applying Head-Related Transfer Functions, or other known ways of creating a spatial effects based on a single input signal and its direction.

In preferred embodiments, the decoding of the input signal into the number of output channels represents determining an array of at least one, such as two, three or four, virtual loudspeaker positions selected such that one or more of the virtual loudspeaker positions at least substantially coincides, such as precisely coincides, with the at least one dominant direction, decoding the audio input signal into virtual loudspeaker signals corresponding to each of the virtual loudspeaker positions, and apply a suitable transfer function to the virtual loudspeaker signals so as to spatially map the virtual loudspeaker positions into the number of output channels representing fixed spatial directions.

Even though such steps may not be directly present in a practical implementation of an audio processor or a software to run on such processor, the above virtual loudspeaker positions and signals represent a virtual analogy to explain a preferred version of the invention.

The filter bank may comprise at least 500, such as 1000 to 5000, preferably partially overlapping filters covering the frequency range of 0 Hz to 22 kHz. E.g. specifically, an FFT analysis with a window length of 2048 to 8192 samples, i.e. 1024-4096 bands covering 0-22050 Hz may be used. However, it is appreciated that the invention may be performed also with fewer filters, in case a reduced performance is accepted.

The sound source separation unit preferably determines the at least one dominant direction in each frequency band for each time frame, such as a time frame having a size of 2,000 to 10,000 samples, e.g. 2048-8192, as mentioned. However, it is to be understood that a lower update of the dominant direction may be used, in case a reduced performance is accepted.

The number of virtual loudspeakers should be equal to or greater than the number of dominant directions determined by the parametric plane wave decomposition computation. The ideal number of virtual loudspeakers depends on the size of the loudspeaker array and the size of the listening area. In cases where additional virtual loudspeakers beyond the ones determined through parametric plane wave decomposition are found to be advantageous, the positions of the virtual loudspeakers may be determined by the construction of a geometric figure whose vertices lie on the unit sphere. The figure is constructed so that dominant directions coincide with vertices of the figure. Hereby it is ensured that the most dominating sound sources, in a frequency band, are as precisely spatially represented as possible, thus leading to the best possible spatial reproduction of audio material with several dominant sound sources spatially distributed, e.g. two singers or two musical instruments playing at the same time. The remaining vertices determine the positions of the additional virtual loudspeakers. Their exact locations have little effect on the resulting sound quality, so long as no pair of vertices lie too close to each other. One specific calculation which ensures good spacing is that of simulating point charges constrained to lie on the surface of a sphere. Since equal charges repel each other, the equilibrium position of this system provides well-spaced locations on the unit sphere.

As another example, which is applicable in the case where the number of dominant directions is 1 or 2 and the preferred number of virtual loudspeakers is 3 or 4, the following geometric constructions are suitable for calculating the extra vertices:

| Number of dominant directions | Number of virtual loudspeakers | Method of construction |
|---|---|---|
| 1 | 3 | Rotation of equilateral triangle |
| 2 | 3 | Construction of isosceles triangle |
| 1 | 4 | Rotation of regular tetrahedron |
| 2 | 4 | Construction of irregular tetrahedron with identical faces |

In order to generate a multichannel output signal, for example two or more channels suitable for playback over an array of loudspeakers, the audio processor may comprise a multichannel synthesizer unit arranged to generate any number of audio output signals by applying suitable transfer functions to each of the virtual loudspeaker signals. The transfer functions are determined from the directions of the virtual loudspeakers. Several methods suitable for determining such transfer functions are known.

By way of example, one can mention amplitude panning, vector base amplitude panning, wave field synthesis, virtual microphone characteristics and ambisonics equivalent panning. These methods all produce output signals suitable for playback over an array of loudspeakers. One might also choose to use spherical harmonics as transfer functions, in which case the output signals are suitable for decoding by a higher-order ambisonic decoder. Other transfer functions may also be suitable. Especially, such audio processor may be implemented by a decoding matrix corresponding to the determined virtual loudspeaker positions and a transfer function matrix corresponding to the directions and the selected panning method, combined into an output transfer matrix prior to being applied to the audio input signals. Hereby a smoothing may be performed on transfer functions of such output transfer matrix prior to being applied to the input signals, which will serve to improve reproduction of transient sounds.

In order to generate a binaural two-channel output signal, the audio processor may comprise a binaural synthesizer unit arranged to generate first and second audio output signals by applying Head-Related Transfer Functions to each of the virtual loudspeaker signals. Especially, such audio processor may be implemented by a decoding matrix corresponding to the determined virtual loudspeaker positions and a transfer function matrix corresponding to the Head-Related Transfer Functions being combined into an output transfer matrix prior to being applied to the audio input signals. Hereby a smoothing may be performed on transfer functions of such output transfer matrix prior to being applied to the input signals, which will serve to improve reproduction of transient sounds.

The audio input signal is preferably a multi-channel audio signal arranged for decomposition into plane wave components. Especially, the input signal may be one of: a periphonic B-format sound field signal or a horizontal-only B-format sound field signal.

In a second aspect, the invention provides a device comprising an audio processor according to the first aspect. Especially, the device may be one of: a device for recording sound or video signals, a device for playback of sound or video signals, a portable device, a computer device, a video game device, a hi-fi device, an audio converter device, and a headphone unit.

In a third aspect, the invention provides a method for converting a multi-channel audio input signal comprising three or four channels, such as a B-format sound field signal, into a set of audio output signals, such as a set of two audio output signals (L, R) arranged for headphone reproduction or two or more audio output signals arranged for playback over an array of loudspeakers, the method comprising separating the audio input signal into a plurality of frequency bands, such as partially overlapping frequency bands, performing a sound source separation comprising performing a parametric plane wave decomposition computation on the multi-channel audio input signal so as to determine at least one dominant direction corresponding to a direction of a dominant sound source in the audio input signal, decoding the audio input signal into a number of output channels, wherein said decoding is controlled according to said at least one dominant direction, and summing the resulting signals of the respective output channels for the at least part of the plurality of frequency bands to arrive at the set of audio output signals.

The method may be implemented in pure software, e.g. in the form of a generic code or in the form of a processor specific executable code. Alternatively, the method may be implemented partly in specific analog and/or digital electronic components and partly in software. Still alternatively, the method may be implemented in a single dedicated chip.

It is appreciated that two or more of the mentioned embodiments can advantageously be combined. It is also appreciated that embodiments and advantages mentioned for the first aspect, applies as well for the second and third aspects.

BRIEF DESCRIPTION OF THE DRAWING

Embodiments of the invention will be described, by way of example only, with reference to the drawings.

DESCRIPTION OF EMBODIMENTS

Figure 1:
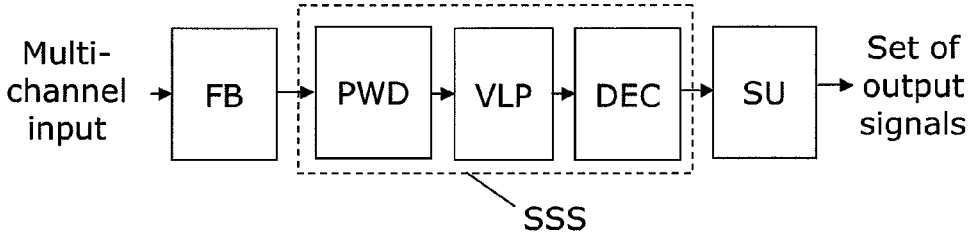
FIG. 1 illustrates basic components of one embodiment of the audio processor.

FIG. 1 shows an audio processor component with basic components according to the invention. Input to the audio processor is a multi-channel audio signal. This signal is split into a plurality of frequency bands in a filter bank, e.g. in the form of an FFT analysis performed on each of the plurality of channels. A sound source separation unit SSS is then performed on the frequency separated signal. First, a parametric plane wave decomposition calculation PWD is performed on each frequency band in order to determine one or two dominant sound source directions. The dominant sound source directions are then applied to a virtual loudspeaker position calculation algorithm VLP serving to select a set of virtual sound source or virtual loudspeaker directions, e.g. by rotation of a fixed set of virtual loudspeaker directions, such that the one or both, in case of two, dominant sound source directions coincide with respective virtual loudspeaker directions. The precise operation performed by the VLP depends on the number of direction estimates and the desired number of virtual loudspeakers. That number in turn depends on the number of input channels, the size of the loudspeaker array and the size of the listening area. A larger number of virtual loudspeakers generally leads to a better sense of envelopment for listeners in a central listening position, whereas a smaller number of virtual loudspeakers leads to more accurate localization for listeners outside of the central listening position.

Then, the input signal is transferred or decoded DEC according to a decoding matrix corresponding to the selected virtual loudspeaker directions, and optionally Head-Related Transfer Functions or other direction-dependant transfer functions corresponding to the virtual loudspeaker directions are applied before the frequency components are finally combined in a summation unit SU to form a set of output signals, e.g. two output signals in case of a binaural implementation, or such as four, five, six, seven or even more output signals in case of conversion to a format suitable for reproduction through a surround sound set-up of loudspeakers. If the filter bank is implemented as an FFT analysis, the summation may be implemented as an IFFT transformation followed by an overlap-add step.

The audio processor can be implemented in various ways, e.g. in the form of a processor forming part of a device, wherein the processor is provided with executable code to perform the invention.

Figure 2:
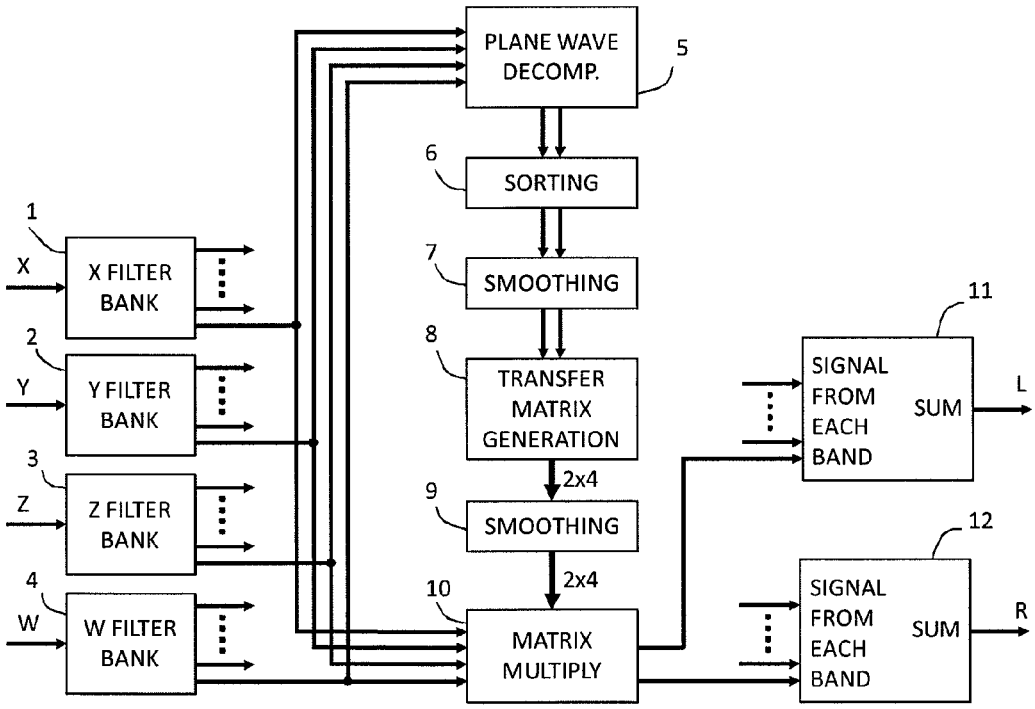
FIG. 2 illustrates details of an embodiment for converting a B-format sound field signal into a binaural signal.
Figure 3:
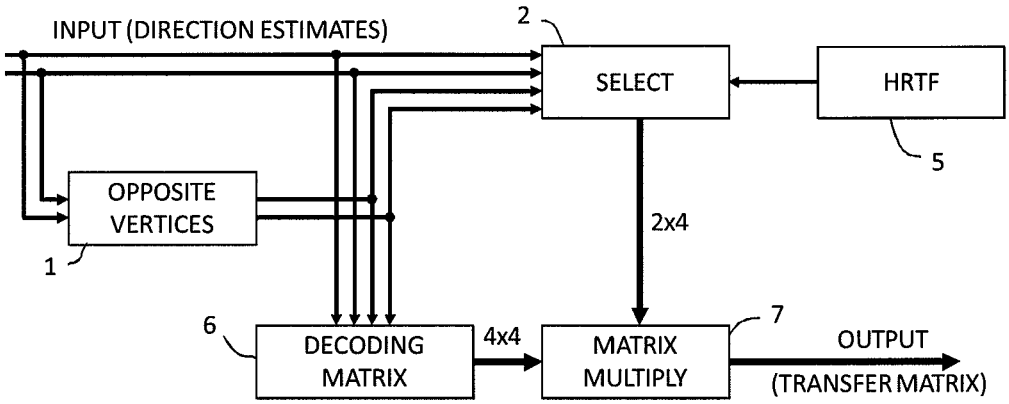
FIG. 3 illustrates a possible implementation of the transfer matrix generator referred to in FIG. 2.

FIGS. 2 and 3 illustrate components of a preferred embodiment suited to convert an input signal having a three dimensional characteristics and is in an "ambisonic B-format". The ambisonic B-format system is a very high quality sound positioning system which operates by breaking down the directionality of the sound into spherical harmonic components termed W, X, Y and Z. The ambisonic system is then designed to utilize a plurality of output speakers to cooperatively recreate the original directional components. For a description of the B-format system, reference is made to: http://en.wikipedia.org/wiki/Ambisonics.

Referring to FIG. 2, the preferred embodiment is directed at providing an improved spatialization of input audio signals. A B-format signal is input having X, Y, Z and W components. Each component of the B-format input set is processed through a corresponding filter bank (1)-(4) each of which divides the input into a number of output frequency bands (The number of bands being implementation dependent, typically in the range of 1024 to 4096).

Elements (5), (6), (7), (8) and (10) are replicated once for each frequency band, although only one of each is shown in FIG. 2. For each frequency band, the four signals (one from each filter bank (1)-(4)) are processed by a parametric plane wave decomposition element (5), which determines the smallest number of plane waves necessary to recreate the local sound field encoded in the four signals. The parametric plane wave decomposition element also calculates the direction, phase and amplitude of these waves. The input signal is denoted w, x, y, z, with subscripts r and i. In the following, it is assumed that the channels are scaled such that the maximum amplitude of a single plane wave would be equal in all channels. This implies that the W channel may have to be scaled by a factor of 1, $\sqrt{2}$ or $\sqrt{3}$, depending on whether the input signal is scaled according to the SN3D, FuMa or N3D conventions, respectively. The local sound field can in most cases be recreated by two plane waves, as expressed in the following equations:

$$\begin{bmatrix} w_1 \\ x_1 \\ y_1 \\ z_1 \end{bmatrix} e^{i\phi_1} + \begin{bmatrix} w_2 \\ x_2 \\ y_2 \\ z_2 \end{bmatrix} e^{i\phi_2} = \begin{bmatrix} w_r \\ x_r \\ y_r \\ z_r \end{bmatrix} + \begin{bmatrix} w_i \\ x_i \\ y_i \\ z_i \end{bmatrix} i \tag{1}$$

$$x_1^2 + y_1^2 + z_1^2 = w_1^2 \tag{2}$$

$$x_2^2 + y_2^2 + z_2^2 = w_2^2 \tag{3}$$

The solution to these equations is $$\begin{bmatrix} w_1 & x_1 & y_1 & z_1 \\ w_2 & x_2 & y_2 & z_2 \end{bmatrix} = \begin{bmatrix} \cos\phi_1 & \cos\phi_1 \\ \sin\phi_2 & \sin\phi_2 \end{bmatrix}^{-1} \begin{bmatrix} w_r & x_r & y_r & z_r \\ w_i & x_i & y_i & z_i \end{bmatrix} \tag{4}$$

where $$\cos^2\phi_n = \frac{2a^2 - bc + b^2 \pm 2a\sqrt{a^2 - bc}}{(c-b)^2 + 4a^2} \tag{5}$$

$$a = -w_r w_i + x_r x_i + y_r y_i + z_r z_i \tag{6}$$

$$b = -w_r^2 + x_r^2 + y_r^2 + z_r^2 \tag{7}$$

$$c = -w_i^2 + x_i^2 + y_i^2 + z_i^2 \tag{8}$$

The two possible signs in equation 5 gives the values of $\cos^2\phi_1$ and $\cos^2\phi_2$, respectively, as long as $a^2-bc$ is nonnegative. Each value for $\cos^2\phi_n$ corresponds to several possible values of $\phi_n$, one in each quadrant, or the values 0 and n, or the values n/2 and 3n/2. Only one of these is correct. The correct quadrant can be determined from equation 9 and the requirement that $w_1$ and $w_2$ should be positive.

$$\sin\phi_n \cos\phi_n = \frac{(c-b)\cos^2\phi_n + b}{2a} \tag{9}$$

When equation 5 gives no real solutions, more than two plane waves are necessary to reconstruct the local sound field. It may also be advantageous to use an alternative method when the matrix to invert in equation 4 is singular or nearly singular. When allowing for more than two plane waves, an infinite number of possible solutions exist. Since this alternative method is necessary only for a small part of most signals, the choice of solution is not critical. One possible choice is that of two plane waves travelling in the directions of the principal axes of the ellipse which is described by the time-dependent velocity vector associated with each frequency band. In addition to these two plane waves, a spherical wave is necessary to reconstruct the W component of the incoming signal:

$$\begin{bmatrix} w_0 \\ 0 \\ 0 \\ 0 \end{bmatrix} e^{i\phi_0} + \begin{bmatrix} w_1 \\ x_1 \\ y_1 \\ z_1 \end{bmatrix} e^{i\phi_1} + \begin{bmatrix} w_2 \\ x_2 \\ y_2 \\ z_2 \end{bmatrix} e^{i\phi_2} = \begin{bmatrix} w_r \\ x_r \\ y_r \\ z_r \end{bmatrix} + \begin{bmatrix} w_i \\ x_i \\ y_i \\ z_i \end{bmatrix} i \tag{10}$$

-continued $$x_1^2 + y_1^2 + z_1^2 = w_1^2 \tag{11}$$

$$x_2^2 + y_2^2 + z_2^2 = w_2^2 \tag{12}$$

The chosen solution is $$\begin{bmatrix} w_1' & x_1 & y_1 & z_1 \\ w_2' & x_2 & y_2 & z_2 \end{bmatrix} = \begin{bmatrix} \cos\phi_1 & \cos\phi_1 \\ \sin\phi_2 & \sin\phi_2 \end{bmatrix}^{-1} \begin{bmatrix} w_r & x_r & y_r & z_r \\ w_i & x_i & y_i & z_i \end{bmatrix} \tag{13}$$

where $$\cos^2\phi_n = \frac{1}{2} \pm \frac{b-c}{2\sqrt{4a^2 + (b-c)^2}} \tag{14}$$

$$a = x_r x_i + y_r y_i + z_r z_i \tag{15}$$

$$b = x_r^2 + y_r^2 + z_r^2 \tag{16}$$

$$c = x_i^2 + y_i^2 + z_i^2 \tag{17}$$

As before, the quadrant of $\phi$ can be determined based on another equation (18) and the requirement that $w'_1$ and $w'_2$ should be positive.

$$\sin\phi_n \cos\phi_n = \frac{2a\cos^2\phi_n - a}{b-c} \tag{18}$$

The values of $w_o$, and $\phi_0$ are not used in subsequent steps.

The output of (5) consists of the two vectors $<x_1, y_1, z_1>$ and $<x_2, y_2, z_2>$. This output is connected to an element (6) which sorts these two vectors in accordance to their lengths or the value of their y element. In an alternative embodiment of the invention, only one of the two vectors is passed on from element (6). The choice can be that of the longest vector or the one with the highest degree of similarity with neighbouring vectors. The output of (6) is connected to a smoothing element (7) which suppresses rapid changes in the direction estimates. The output of (7) is connected to an element (8) which generates suitable transfer functions from each of the input signals to each of the output signals, a total of eight transfer functions. Each of these transfer functions are passed through a smoothing element (9). This element suppresses large differences in phase and in amplitude between neighbouring frequency bands and also suppresses rapid temporal changes in phase and in amplitude. The output of (9) is passed to a matrix multiplier (10) which applies the transfer functions to the input signals and creates two output signals. Elements (11) and (12) sum each of the output signals from (10) across all filter bands to produce a binaural signal. It is usually not necessary to apply smoothing both before and after the transfer matrix generation, so either element (7) or element (9) may usually be removed. It is preferable in that case to remove element (7).

Referring to FIG. 3, there is illustrated schematically the preferred embodiment of the transfer matrix generator referenced in FIG. 2. An element (1) generates two new vectors whose directions are chosen so as to distribute the virtual loudspeakers over the unit sphere. In an alternative embodiment of the invention, only one vector is passed into the transfer matrix generator. In this case, element (1) must generate three new vectors, preferably such that the resulting four vectors point towards the vertices of a regular tetrahedron. This alternative approach is also beneficial in cases where the two input vectors are collinear or nearly collinear.

The four vectors are used to represent the directions to four virtual loudspeakers which will be used to play back the input signals. An element (6) calculates a decoding matrix by inverting the following matrix:

$$G = \begin{bmatrix} 1 & x'_1 & y'_1 & z'_1 \\ 1 & x'_2 & y'_2 & z'_2 \\ 1 & x'_3 & y'_3 & z'_3 \\ 1 & x'_4 & y'_4 & z'_4 \end{bmatrix} \tag{19}$$

where $$[\,x'_n \quad y'_n \quad z'_n\,] = \frac{[\,x_n \quad y_n \quad z_n\,]}{\sqrt{x_n^2 + y_n^2 + z_n^2}} \tag{20}$$

An element (5) stores a set of head-related transfer functions.

Element (2) uses the virtual loudspeaker directions to select and interpolate between the head-related transfer functions closest to the direction of each virtual loudspeaker. For each virtual loudspeaker, there are two head-related transfer functions; one for each ear, providing a total of eight transfer functions which are passed to element (7). The outputs of elements (2) and (6) are multiplied in a matrix multiplication (7) to produce the suitable transfer matrix.

The design illustrated in FIG. 2 may be modified in the following ways to produce a multi-channel output suitable for feeding a loudspeaker array of n loudspeakers:

- The transfer matrix generator (8) is modified to produce n×4 transfer functions instead of 2×4.
- The smoothing element (9) is modified to smooth n×4 transfer functions.
- The matrix multiplier (10) is modified to multiply the input signal vector with an n×4 matrix and to produce an output vector with n elements.
- Additional summing units are added to process the additional outputs of (10).

The design illustrated in FIG. 3 may be modified in the following ways to produce n×4 transfer functions suitable for producing a multi-channel output:

- The Head-Related Transfer Functions in element (5) are replaced by pairwise panning functions, vector-base amplitude panning functions, virtual microphone characteristics or other functions suitable to produce the illusion of sound emanating from the directions of the virtual loudspeakers.
- Element (2) is modified to select n×4 transfer functions instead of 2×4.
- Element (7) is modified to produce n×4 transfer functions instead of 2×4.

The design illustrated in FIG. 2 may be modified in the following ways to process three audio input signals constituting a horizontal-only B-format signal:

- The Z filter bank (3) is removed
- The plane wave decomposition element (5) is modified by removing $z_r$, $z_i$, $z_1$ and $z_2$ from equations 1-17.
- The matrix multiplier (10) is modified to receive tree inputs instead of four.
- The smoothing element (9) is modified to smooth 2×3 transfer functions instead of 2×4.
- The transfer matrix generator (8) is modified to produce 2×3 transfer functions instead of 2×4.

The design illustrated in FIG. 3 may be modified in the following ways to produce 2×3 transfer functions suitable for processing three audio input signals constituting a horizontal-only B-format signal:

- Element (1) generates one new vector whose direction is chosen so as to maximize the angles between the three resulting vectors. In an alternative embodiment of the invention, only one vector is sometimes passed into the transfer matrix generator. In this case, element (1) must generate two new vectors, preferably such that the resulting three vectors point towards the vertices of an equilateral triangle.
- Element (6) calculates a decoding matrix by inverting the following matrix:

$$G \equiv \begin{bmatrix} 1 & x'_1 & y'_1 \\ 1 & x'_2 & y'_2 \\ 1 & x'_3 & y'_3 \end{bmatrix} \tag{21}$$

where $$[\,x'_n \quad y'_n\,] = \frac{[\,x_n \quad y_n\,]}{\sqrt{x_n^2 + y_n^2}} \tag{22}$$

- Element (2) is modified to select 2×3 transfer functions instead of 2×4.
- Element (4) is modified to integrate the phase of 2×3 transfer functions instead of 2×4.
- Element (7) is modified to produce 2×3 transfer functions instead of 2×4.

In cases where a number of virtual loudspeakers different from the number of input channels is found to be advantageous, the design in FIG. 3 may be modified in the following way:

- The opposite vertices element (1) is modified to generate a smaller or larger number of directions.
- Element (6) is altered to calculate the Moore-Penrose pseudo-inverse of the matrix G, which is this case is not a square matrix.
- Element (2) is altered to select the required number of transfer functions.
- Element (7) is altered to multiply the differently sized input matrices.

These changes do not alter the shape of the resulting transfer matrix.

Another improvement to the design illustrated in FIG. 3 pertains to transfer functions that contain a time delay, such as head-related transfer functions. The difference in propagation time to each of the two ears leads to an inter-aural time delay which depends on the source location. This delay manifests itself in head-related transfer functions as an inter-aural phase shift that is roughly proportional to frequency and dependent on the source location. In the context of this invention, only an estimate of the source location is known, and any uncertainty in this estimate translates into an uncertainty in inter-aural phase shift which is proportional to frequency. This can lead to poor reproduction of transient sounds.

The human ability to perceive inter-aural phase shift is limited to frequencies below approx. 1200-1600 Hz. Although inter-aural phase shift in itself does not contribute to localization at higher frequencies, the inter-aural group delay does. The inter-aural group delay is defined as the negative partial derivative of the inter-aural phase shift with respect to frequency. Unlike the inter-aural phase shift, the inter-aural group delay remains roughly constant across all frequencies for any given source location. To reduce phase noise, it is therefore advantageous to calculate the inter-aural group delay by numerical differentiation of the HRTFs before element (2) selects HRTFs depending on the directions of the virtual loudspeakers. After selection, but before the resulting transfer functions are passed to element (7), it is necessary to calculate the phase shift of the resulting transfer functions by numerical integration.

Figure 4:
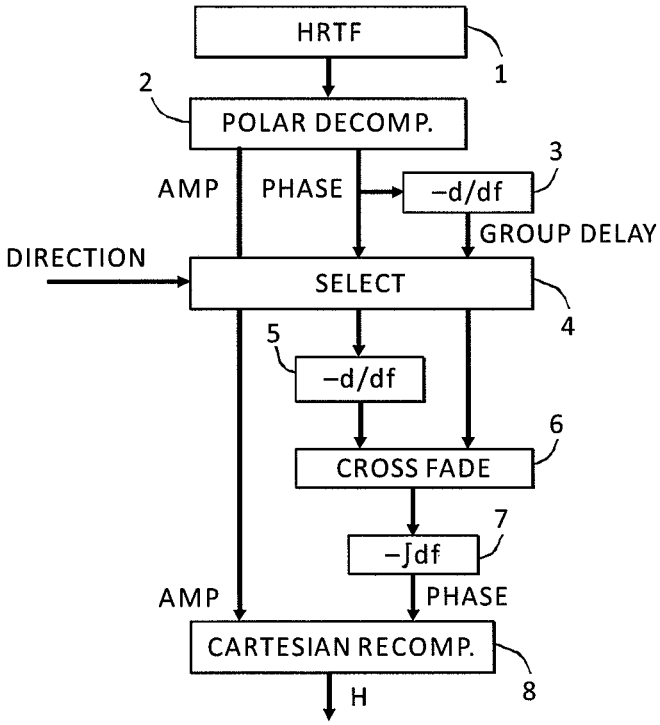
FIG. 4 illustrates an improved HRTF selection process which can be used in FIG. 2.

This phase noise reduction process is illustrated in FIG. 4. Element (1) stores a set of HRTFs for different directions of incidence. Element (2) decomposes these transfer functions into an amplitude part and a phase part. Element (3) differentiates the phase part in order to calculate a group delay. Element (4) selects and (optionally) interpolates an amplitude, phase and group delay based on a direction of arrival. Element (5) differentiates the resulting phase shift after selection. Element (6) calculates a linear combination of the two group delay estimates such that its left input is used at low frequencies, transitioning smoothly to the right input for frequencies above 1600 Hz. Element (7) recovers a phase shift from the group delay and element (8) recovers a transfer function in Cartesian (real/imaginary) components, suitable for further processing.

This process may advantageously substitute element (2) in FIG. 3, where one instance of the process would be required for each virtual loudspeaker. Since the process indirectly connects direction estimates from neighbouring frequency bands, it is preferable if each sound source is sent to the same virtual loudspeaker for all neighbouring frequency bands where it is present. This is the purpose of the sorting element (6) in FIG. 2.

The same process is also applicable to other panning functions than HRTFs that contain an inter-channel delay. Examples are the virtual microphone response characteristics of an ORTF or Decca Tree microphone setup or any other spaced virtual microphone setup.

In the arrangement shown in FIG. 3, the decoding matrix is multiplied with the transfer function matrix before their product is multiplied with the input signals. In an alternative embodiment of the invention, the input signals are first multiplied with the decoding matrix and their product subsequently multiplied with the transfer function matrix. However, this would preclude the possibility of smoothing of the overall transfer functions. Such smoothing is advantageous for the reproduction of transient sounds.

The overall effect of the arrangement shown in FIGS. 2 and 3 is to decompose the full spectrum of the local sound field into a large number of plane waves and to pass these plane waves through corresponding head-related transfer functions in order to produce a binaural signal suited for headphone reproduction.

Figure 5:
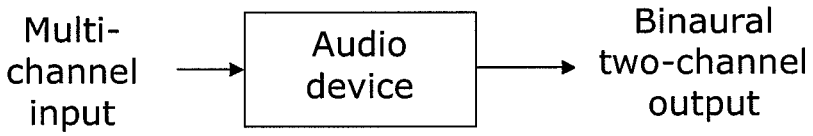
FIG. 5 illustrates an audio device with an audio processor according to the invention.

FIG. 5 illustrates a block diagram of an audio device with an audio processor according to the invention, e.g. the one illustrated in FIGS. 2 and 3. The device may be a dedicated headphone unit, a general audio device offering the conversion of a multi-channel input signal to another output format as an option, or the device may be a general computer with a sound card provided with software suited to perform the conversion method according to the invention.

The device may be able to perform on-line conversion of the input signal, e.g. by receiving the multi-channel input audio signal in the form of a digital bit stream. Alternatively, e.g. if the device is a computer, the device may generate the output signal in the form of an audio output file based on an audio file as input.

Figure 6:
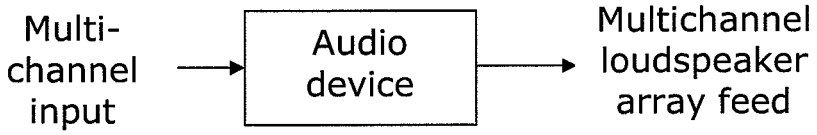
FIG. 6 illustrates another audio device with an audio processor according to the invention.

FIG. 6 illustrates a block diagram of an audio device with an audio processor according to the invention, e.g. the one illustrated in FIGS. 2 and 3, modified for multichannel output. The device may be a dedicated decoder unit, a general audio device offering the conversion of a multi-channel input signal to another output format as an option, or the device may be a general computer with a sound card provided with software suited to perform the conversion method according to the invention.

In the following, a set of embodiments E1-E15 of the invention is defined:

E1. An audio processor arranged to convert a multi-channel audio input signal (X, Y, Z, W) comprising at least two channels, such as a B-format Sound Field signal, into a set of audio output signals (L, R), such as a set of two audio output signals (L, R) arranged for headphone reproduction, the audio processor comprising

- a filter bank arranged to separate the input signal (X, Y, Z, W) into a plurality of frequency bands, such as partially overlapping frequency bands,
- a sound source separation unit arranged, for at least a part of the plurality of frequency bands, to
  - perform a plane wave expansion computation on the multi-channel audio input signal (X, Y, Z, W) so as to determine at least one dominant direction corresponding to a direction of a dominant sound source in the audio input signal (X, Y, Z, W),
  - determine an array of at least two, such as four, virtual loudspeaker positions selected such that one or more of the virtual loudspeaker positions at least substantially coincides, such as precisely coincides, with the at least one dominant direction, and
  - decode the audio input signal (X, Y, Z, W) into virtual loudspeaker signals corresponding to each of the virtual loudspeaker positions, and
- a summation unit arranged to sum the virtual loudspeaker signals for the at least part of the plurality of frequency bands to arrive at the set of audio output signals (L, R).

E2. Audio processor according to E1, wherein the filter bank comprises at least 500, such as 1000 to 5000, partially overlapping filters covering a frequency range of 0 Hz to 22 kHz.

E3. Audio processor according to E1 or E2, wherein the virtual loudspeaker positions are selected by a rotation of a set of at least three positions in a fixed spatial interrelation.

E4. Audio processor according to E3, wherein the set of positions in a fixed spatial interrelation comprises four positions, such as four positions arranged in a tetrahedron.

E5. Audio processor according to any of E1-E4, wherein the wave expansion determines two dominant directions, and wherein the array of at least two virtual loudspeaker positions is selected such that two of the virtual loudspeaker positions at least substantially coincides, such as precisely coincides, with the two dominant directions.

E6. Audio processor according E1-E5, comprising a binaural synthesizer unit arranged to generate first and second audio output signals (L, R) by applying Head-Related Transfer Functions (HRTF) to each of the virtual loudspeaker signals.

E7. Audio processor according to E6, wherein a decoding matrix corresponding to the determined virtual loudspeaker positions and a transfer function matrix corresponding to the Head-Related Transfer Functions (HRTF) are being combined into an output transfer matrix prior to being applied to the audio input signals (X, Y, Z, W).

E8. Audio processor according to E7, wherein a smoothing is performed on transfer functions of the output transfer matrix prior to being applied to the input signals (X, Y, Z, W).

E9. Audio processor according to any of E6-E8, wherein the phase of the Head-Related Transfer Functions (HRTF) is differentiated with respect to frequency, and after combining components of Head-Related Transfer Functions (HRTF)

corresponding to different directions, the phase of the combined transfer functions is integrated with respect to frequency.

E10. Audio processor according to any of E1-E9, wherein the phase of the Head-Related Transfer Functions (HRTF) is left unaltered below a first frequency limit, such as below 1.6 kHz, and differentiated with respect to frequency at frequencies above a second frequency limit with a higher frequency than the first frequency limit, such as 2.0 kHz, and with a gradual transition in between, and after combining components of Head-Related Transfer Functions (HRTF) corresponding to different directions, the inverse operation is applied to the combined function.

E11. Audio processor according to any of E1-E10, wherein the audio input signal is a multi-channel audio signal arranged for decomposition into plane wave components, such as one of: a B-format sound field signal, a higher-order ambisonics recording, a stereo recording, and a surround sound recording.

E12. Audio processor according to any of E1-E12, wherein the sound source separation unit determines the at least one dominant direction in each frequency band for each time frame, wherein a time frame has a size of 2,000 to 10,000 samples.

E13. Audio processor according to any of E1-E12, wherein the set of audio output signals (L, R) is arranged for playback over headphones.

E14. Device comprising an audio processor according to E1-E13, such as the device being one of: a device for recording sound or video signals, a device for playback of sound or video signals, a portable device, a computer device, a video game device, a hi-fi device, an audio converter device, and a headphone unit.

E15. Method for converting a multi-channel audio input signal (X, Y, Z, W) comprising at least two channels, such as a B-format Sound Field signal, into a set of audio output signals (L, R), such as a set of two audio output signals (L, R) arranged for headphone reproduction, the method comprising separating the input signal (X, Y, Z, W) into a plurality of frequency bands, such as partially overlapping frequency bands, performing a sound source separation for at least a part of the plurality of frequency bands, comprising performing a plane wave expansion computation on the multi-channel audio input signal (X, Y, Z, W) so as to determine at least one dominant direction corresponding to a direction of a dominant sound source in the audio input signal (X, Y, Z, W), determining an array of at least two, such as four, virtual loudspeaker positions selected such that one or more of the virtual loudspeaker positions at least substantially coincides, such as precisely coincides, with the at least one dominant direction, and decoding the audio input signal (X, Y, Z, W) into virtual loudspeaker signals corresponding to each of the virtual loudspeaker positions, and summing the virtual loudspeaker signals for the at least part of the plurality of frequency bands to arrive at the set of audio output signals (L, R).

In the following, another set of embodiments EE1-EE24 of the invention is defined:

EE1. An audio processor arranged to convert a multi-channel audio input signal comprising at least two channels, such as a stereo signal or a three- or four-channel B-format Sound Field signal, into a set of audio output signals, such as a set of two audio output signals arranged for headphone or two or more audio output signals arranged for playback over an array of loudspeakers, the audio processor comprising a filter bank arranged to separate the input signal into a plurality of frequency bands, such as partially overlapping frequency bands, a sound source separation unit arranged, for at least a part of the plurality of frequency bands, to perform a plane wave expansion computation on the multi-channel audio input signal so as to determine at least one dominant direction corresponding to a direction of a dominant sound source in the audio input signal, perform a decoding of the audio input signal into a number of output channels, wherein said decoding is controlled according to said at least one dominant direction, and a summation unit arranged to sum the resulting signals of the respective output channels for the at least part of the plurality of frequency bands to arrive at the set of audio output signals.

EE2. Audio processor according to EE1, wherein said decoding of the input signal into the number of output channels represents determining an array of at least two, such as four, virtual loudspeaker positions selected such that one or more of the virtual loudspeaker positions at least substantially coincides, such as precisely coincides, with the at least one dominant direction, decoding the audio input signal into virtual loudspeaker signals corresponding to each of the virtual loudspeaker positions, and apply a suitable transfer function to the virtual loudspeaker signals so as to spatially map the virtual loudspeaker positions into the number of output channels representing fixed spatial directions.

EE3. Audio processor according to EE1 or EE2, wherein the multi-channel audio input signal comprises two, three or four channels, wherein the filter bank is arranged to separate each of the audio input channels into a plurality of frequency bands, such as partially overlapping frequency bands, wherein a plane wave expansion unit is arranged to expand a local sound field represented in the audio input channels into two plane waves or at least determines one or two estimated directions of arrival, wherein an opposite vertices unit arranged to complement the estimated directions with phantom directions, wherein a decoding matrix calculator is arranged to calculate a decoding matrix suitable for decomposing the audio input signal into feeds for virtual loudspeakers, where directions of said virtual loudspeakers are determined by the combined outputs of the plane wave expansion unit and the opposite vertices unit, wherein a transfer function selector is arranged to calculate a matrix of transfer functions suitable, such as head-related transfer functions, to produce an illusion of sound emanating from the directions of said virtual loudspeakers, wherein a first matrix multiplication unit is arranged to multiply the outputs of the decoding matrix calculator and the transfer function selector, wherein a second matrix multiplication unit is arranged to multiply an of the filter bank with an output of the first matrix multiplication unit, such as an output of a smoothing unit operating on the output of the first matrix multiplication unit, and wherein a plurality of summation units are arranged to sum the respective signals in the plurality of frequency bands to produce the set of audio output signals.

EE4. Audio processor according to EE1-EE3, wherein the filter bank comprises at least 20, such as at least 100, such as at least 500, such as 1000 to 5000, partially overlapping filters covering a frequency range of 0 Hz to 22 kHz.

EE5. Audio processor according to EE1-EE4, wherein a smoothing unit is connected between the plane wave expansion unit and at least one unit that receives an output of the plane wave expansion unit, wherein the smoothing unit is arranged to suppress large differences in direction estimates between neighbouring frequency bands and rapid changes of direction in time.

EE6. Audio processor according to EE1-EE5, wherein the first matrix multiplication unit is connected to receive an output of the filter bank and to the decoding matrix calculator, and wherein the second matrix multiplication unit is connected to the first matrix multiplication unit and the transfer function selector.

EE7. Audio processor according to any of EE1-EE6, wherein a smoothing unit is connected between the first and second matrix multiplication units, wherein the smoothing unit is arranged to suppress large differences between corresponding matrix elements in neighbouring frequency bands and rapid changes of matrix elements in time.

EE8. Audio processor according to any of EE1-EE7, comprising a transfer function selector that selects transfer functions from a database of Head-Related Transfer Functions (HRTF), thus producing two output channels suitable for playback over headphones.

EE9. Audio processor according to EE8, wherein a phase differentiator calculates the phase difference of the Head-Related Transfer Functions (HRTF) between neighbouring frequency bands, and wherein a phase integrator accumulates the phase differences after combining components of Head-Related Transfer Functions (HRTF) corresponding to different directions.

EE10. Audio processor according to EE9, wherein the phase differentiator leaves the phase unaltered below a first frequency limit, such as below 1.6 kHz, and calculates the phase difference between neighbouring frequency bands above a second frequency limit with a higher frequency than the first frequency limit, such as 2.0 kHz, and with a gradual transition in between, and where the phase integrator performs the inverse operation.

EE11. Audio processor according to any of EE1-EE10, comprising a transfer function selector that selects transfer functions according to a pairwise panning law, thus producing two or more output channels suitable for playback over a horizontal array of loudspeakers.

EE12. Audio processor according to any of EE1-EE11, comprising a transfer function selector that selects transfer functions in accordance with vector-base amplitude panning, ambisonics-equivalent panning, or wavefield synthesis, thus producing four or more output channels suitable for playback over a 3D array of loudspeakers.

EE13. Audio processor according to any of EE1-EE12, comprising a transfer function selector that selects transfer by evaluating spherical harmonic functions, thus producing three or more output channels suitable for decoding with a first-order ambisonics decoder or a higher-order ambisonics decoder.

EE14. Audio processor according to any of EE1-EE13, wherein the audio input signal is a three or four channel B-format sound field signal.

EE15. Audio processor according to any of EE1-EE14, wherein a delay unit is connected to the output of the filter bank and the input of the plane wave expansion unit, and wherein the direct connection between said two units is maintained, and wherein the audio input signal is a stereo signal, such as a stereo mix of a plurality of sound sources, such as a mix using a pan-pot technique.

EE16. Audio processor according to EE15, wherein the audio input signal originates from a coincident microphone setup, such as a Blumlein pair, an X/Y pair, a Mid/Side setup with a cardioid mid microphone, a Mid/Side setup with a hypercardioid mid microphone, a Mid/Side setup with a subcardioid mid microphone, a Mid/Side setup with an omnidirectional mid microphone.

EE17. Audio processor according to EE16, wherein the measured sensitivity of the microphones, as a function of azimuth and frequency, is used in the plane wave expansion unit and in the decoding matrix calculator.

EE18. Audio processor according to any of EE15-EE17, wherein a second delay unit is inserted between the outputs of the filter bank and the second matrix multiplication unit.

EE19. Audio processor according to any of EE1-EE18, wherein the sound source separation unit operates on inputs with a time frame having a size of 1,000 to 20,000 samples, such as 2,000 to 10,000 samples, such as 3,000-7,000 samples.

EE20. Audio processor according to EE19, wherein the plane wave expansion unit determines only one dominant direction in each frequency band for each time frame.

EE21. Device comprising an audio processor according to any of the preceding claims, such as the device being one of: a device for recording sound or video signals, a device for playback of sound or video signals, a portable device, a computer device, a video game device, a hi-fi device, an audio converter device, and a headphone unit.

EE22. Method for converting a multi-channel audio input signal comprising at least two, such as two, three or four, channels, such as a stereo signal or a B-format Sound Field signal, into a set of audio output signals, such as a set of two audio output signals (L, R) arranged for headphone reproduction or two or more audio output signals arranged for playback over an array of loudspeakers, the method comprising

- separating the audio input signal into a plurality of frequency bands, such as partially overlapping frequency bands,
- performing a sound source separation comprising
  - performing a plane wave expansion computation on the multi-channel audio input signal so as to determine at least one dominant direction corresponding to a direction of a dominant sound source in the audio input signal,
  - decoding the audio input signal into a number of output channels, wherein said decoding is controlled according to said at least one dominant direction, and
- summing the resulting signals of the respective output channels for the at least part of the plurality of frequency bands to arrive at the set of audio output signals.

EE23. Method according to EE22, wherein said step of decoding the input signal into the number of output channels represents

- determining an array of at least two, such as four, virtual loudspeaker positions selected such that one or more of the virtual loudspeaker positions at least substantially coincides, such as precisely coincides, with the at least one dominant direction, decoding the audio input signal into virtual loudspeaker signals corresponding to each of the virtual loudspeaker positions, and apply a suitable transfer function to the virtual loudspeaker signals so as to spatially map the virtual loudspeaker positions into the number of output channels representing fixed spatial directions.

EE24. Method according to EE22 or EE23, comprising calculating parameters necessary to expand the local sound field into two plane waves or determining at least one or two estimated directions of arrival, complementing the estimated directions with phantom directions such that a total number equals the number of input channels, calculating a decoding matrix suitable for decomposing the input signal into virtual speaker feeds, placing the virtual speakers in the directions calculated by the plane wave expansion and in the phantom directions, selecting a matrix of transfer functions suitable to create an illusion of sound emanating from the directions of said virtual loudspeakers multiplying the decoding matrix with the matrix of transfer functions multiplying the resulting matrix with the vector of input signals summing the resulting vector across all frequency bands to produce a set of output audio signals.

It is appreciated that the defined embodiments E1-E15 and EE1-EE24 may in any way be combined with the other embodiments defined previously.

To sum up, the invention provides an audio processor for converting a multi-channel audio input signal, such as a B-format sound field signal, into a set of audio output signals (L, R), such as a set of two or more audio output signals arranged for headphone reproduction or for playback over an array of loudspeakers. A filter bank splits each of the input channels into frequency bands. The input signal is decomposed into plane waves to determine one or two dominant sound source directions. The(se) are used to determine a set of virtual loudspeaker positions selected such that one or two of the virtual loudspeaker positions coincide(s) with one or both of the dominant directions. The input signal is decoded into virtual loudspeaker signals corresponding to each of the virtual loudspeaker positions, and the virtual loudspeaker signals are processed with transfer functions suitable to create the illusion of sound emanating from the directions of the virtual loudspeakers. A high spatial fidelity is obtained due to the coincidence of virtual loudspeaker positions and the determined dominant sound source direction(s).

In the claims, the term "comprising" does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Reference signs are included in the claims however the inclusion of the reference signs is only for clarity reasons and should not be construed as limiting the scope of the claims.

The invention claimed is:

1. An audio processor configured to convert a multi-channel audio input signal comprising three or four audio input channels into a set of audio output signals, the audio processor comprising:

a filter bank configured to separate the multi-channel audio input signal into a plurality of frequency bands;

a sound source separation calculator configured to decode each of the plurality of the frequency bands into a plurality of output channels and wherein each of the plurality of the output channels corresponds to the plurality of the frequency bands, the sound source separation calculator comprising:

a parametric plane wave decomposition calculator, coupled to the filter bank, determines at least one dominant direction corresponding to a direction of a dominant sound source in the multi-channel audio input signal by decomposing a local field represented in the multi-channel audio input signal into two plane waves or at least determining one or two estimated directions of arrival of the sound source, according to the plurality of the frequency bands from the filter bank;

a decoder, coupled to the parametric plane wave decomposition calculator and controlled according to the at least one dominant direction, decodes the multi-channel audio input signal into the plurality of the output channels in the each of the plurality of the frequency bands, the decoder comprising:

an opposite vertices calculator, coupled to the parametric plane wave decomposition calculator, configured to complement the at least one dominant direction with phantom directions according to outputs of the parametric plane wave decomposition calculator;

a decoding matrix calculator, coupled to the opposite vertices calculator and the parametric plane wave decomposition calculator, configured to calculate a decoding matrix for decomposing the multi-channel audio input signal into feeds for virtual loudspeakers, wherein directions of the virtual loudspeakers are determined by a combination of the outputs of the parametric wave decomposition calculator and the complemented at least one dominant direction with phantom directions from the opposite vertices calculator;

a transfer function selector, coupled to the parametric plane wave decomposition calculator and the opposite vertices calculator, configured to calculate a matrix of panning transfer functions to produce an illusion of sound emanating from the directions of the virtual loudspeakers according to the combination of the outputs of the parametric wave decomposition calculator and the complemented at least one dominant direction with the phantom directions from the opposite vertices calculator;

a first matrix multiplication calculator, coupled to the transfer function selector and the decoding matrix calculator, configured to multiply the decoding matrix from the decoding matrix calculator and the panning transfer functions from the transfer function selector to produce outputs corresponding to the plurality of the output channels; and a second matrix multiplication calculator, coupled to the decoder and the filter bank, configured to multiply the each of the plurality of the frequency bands with the produced outputs from the first matrix multiplication calculator so as to produce the plurality of the output channels and wherein each of the plurality of the output channels corresponds to the plurality of the frequency bands; and a plurality of summation calculators, coupled to the second matrix multiplication calculator, configured to sum the plurality of the output channels so as to produce the set of the audio output signals and wherein each of the plurality of the summation calculators sums the each of the plurality of the output channels with respect to the plurality of the frequency bands to produce each of the set of the audio output signals corresponding to the each of the plurality of the output channels.

2. The audio processor according to claim 1, wherein the filter bank comprises at least 20 partially overlapping filters covering a frequency range of 0 Hz to 22 kHz.

3. The audio processor according to claim 1, wherein a smoothing calculator is connected between the decoder and at least one calculator that receives the outputs of the parametric plane wave decomposition calculator, wherein the smoothing calculator is configured to suppress large differences in direction estimates between neighboring frequency bands and rapid changes of direction in time for at least determining the one or two estimated directions of the arrival of the sound source.

4. The audio processor according to claim 1, wherein a smoothing calculator is connected between the first and second matrix multiplication calculators, wherein the smoothing calculator is arranged to suppress large differences in phase or amplitude between corresponding matrix elements in neighboring frequency bands and rapid changes in phase or amplitude of matrix elements in time.

5. The audio processor according to claim 1, wherein the transfer function selector, coupled to a database of Head-Related Transfer Function HRTF, selects transfer functions from the database of the Head-Related Transfer Functions HRTF, for producing two output channels for playback over headphones.

6. The audio processor according to claim 1, wherein the transfer function selector selects transfer functions according to a pair-wise panning law, thereby producing two or more output channels for playback over a horizontal array of loudspeakers.

7. The audio processor according to claim 1, wherein the transfer function selector selects transfer functions in accordance with vector-based amplitude panning, ambisonic-equivalent panning, or wave-field synthesis, thereby producing four or more output channels for playback over a 3D array of loudspeakers.

8. The audio processor according to claim 1, wherein the transfer function selector selects transfer functions by evaluating spherical harmonic functions, thereby producing five or more output channels by decoding with a higher-order ambisonic decoder.

9. The audio processor according to claim 1, wherein the multi-channel audio input signal is a three or four channel B-format sound field signal.

10. The audio processor according to claim 1, wherein the sound source separation calculator operates on inputs with a time frame having a size of 1,000 to 20,000 samples, 2,000 to 10,000 samples, or 3,000-7,000 samples.

11. The audio processor according to claim 10, wherein the parametric plane wave decomposition calculator determines only one dominant direction in each frequency band of the plurality of the frequency bands for each time frame.

12. A device of adapted for recording or playback of sound or video signals, the device comprising:

the audio processor according to claim 1; and one or more speakers in the device for outputting the set of the audio output signals.

13. The device according to claim 12, wherein the device is one of a portable device, a computer device, a video game device, a HI-FI device, an audio converter device, and headphones.

14. A method for converting a multi-channel audio input signal comprising three or four audio input channels into a set of audio output signals, the method comprising:

separating, by a filter bank, the multi-channel audio input signal into a plurality of frequency bands;

performing a sound source separation to decode each of the plurality of the frequency bands into a plurality of output channels and wherein each of the plurality of the output channels corresponds to the plurality of frequency bands, the performing the sound source separation comprising:

performing a parametric plane wave decomposition computation to determine at least one dominant direction corresponding to a direction of a dominant sound source in the multi-channel audio input signal by decomposing a local field represented in the multi-channel audio input signal into two plane waves or at least determining one or two estimated directions of arrival of the sound source, according to the plurality of the frequency bands from the filter bank;

complementing the at least one dominant direction with phantom directions in an opposite vertices, according to the determined at least one dominant direction or the determined one or two estimated directions of the arrival of the sound source;

calculating, in a decoding matrix calculator, a decoding matrix for decomposing the multiple-channel audio input signal into feeds for virtual loudspeakers, wherein directions of the virtual loudspeakers are determined by a combination of the determined at least one dominant direction or the determined one or two estimated directions of the arrival of the sound source and the complemented at least one dominant direction with the phantom directions;

calculating, in a transfer function selector, a matrix of panning transfer functions for producing an illusion of sound emanating from the directions of the virtual loudspeakers according to the combination of the determined at least one dominant direction or the determined one or two estimated directions of the arrival of the sound source and the complemented at least one dominant direction with phantom directions;

multiplying the decoding matrix from the decoding matrix calculator and the matrix of the panning transfer functions from the transfer function selector to produce a multiplication product corresponding to the plurality of the output channels;

multiplying each of the plurality of the frequency bands by the produced multiplication product to produce the plurality of output channels corresponding to the each of the plurality of the frequency bands and wherein the each of the plurality of the output channels corresponds to the plurality of the frequency bands; and summing the each of the produced plurality of the output channels with respect to the plurality of frequency bands so as to produce each of the set of audio output signals corresponding to the each of the plurality of the output channels.

15. The method according to claim 14, the method further comprising:

smoothing amplitude and phase of each element of the produced multiplication product so as to suppress rapid changes over time and large differences between neighboring frequency bands.

* * * * *